United States Patent [19]

Iijima et al.

[11] Patent Number: 4,715,904

[45] Date of Patent: Dec. 29, 1987

[54] METHOD FOR PRODUCING A MAGNET WITH RADIAL MAGNETIC ANISOTROPY

[75] Inventors: Kenzaburo Iijima; Yoshinori Hayashi, both of Shizuoka, Japan

[73] Assignee: Nippon Gakki Seizo Kabushiki Kaisha, Japan

[21] Appl. No.: 583,125

[22] Filed: Feb. 24, 1984

[30] Foreign Application Priority Data

Feb. 28, 1983 [JP] Japan ..... 58-033425

[51] Int. Cl.[4] ..... H01F 1/02

[52] U.S. Cl. ..... 148/102; 148/103

[58] Field of Search ..... 148/102, 103, 108

[56] References Cited

U.S. PATENT DOCUMENTS

| | | | |
|---|---|---|---|
| 3,106,496 | 10/1963 | Anolick | 148/108 |
| 3,117,065 | 1/1964 | Wootten | 148/108 |
| 3,598,662 | 8/1971 | de Vos et al. | 148/103 |
| 4,246,049 | 1/1981 | Bronner et al. | 148/103 |
| 4,253,883 | 3/1981 | Jin | 148/103 |
| 4,305,764 | 12/1981 | Iwata | 148/103 |
| 4,437,907 | 3/1984 | Sato et al. | 148/31.55 |

*Primary Examiner*—John P. Sheehan

*Attorney, Agent, or Firm*—Ostrolenk, Faber, Gerb & Soffen

[57] ABSTRACT

In production of a permanent magnet by forming a roll of an elongated magnetic metal strap, a strap made from a spinodal decomposition type magnetic alloy is subjected, at least before formation into a roll, to age-hardening under concurrent magnetization in order to obtain a magnet having significant radial magnetic anisotropy well suited for use in sound systems such as loudspeakers.

16 Claims, 7 Drawing Figures

METHOD FOR PRODUCING A MAGNET WITH RADIAL MAGNETIC ANISOTROPY

BACKGROUND OF THE INVENTION

The present invention relates to a method for producing a magnet with radial magnetic anisotropy, and more particularly relates to producing of a novel magnet having radial magnetic anisotropy and well suited for use in magnetic circuits in sound systems such as loudspeakers.

Production of a radially magnetized permanent magnet is disclosed in, for example, Japanese Patent Publication Sho. 45-8584, in which the magnet has different poles on the inner and outer radial end sections. In the production process of this prior proposal, a magnetic strap is formed by solidifying magnetic powders of ferrite or the like with rubber, the solidified magnetic strap is next magnetized in its thickness direction, and the magnetized strap is wound up onto a tight roll having the required shape of a magnet.

In the case of this prior proposal, however, choice of the material used for forming the initial magnetic strap is limited to an easily deformable magnetic material such as ferrite or the like solidified with rubber. These magnetic materials are in general isotropic in their magnetic properties and rather unsuited for production of magnets used for the above-described purposes.

SUMMARY OF THE INVENTION

It is the object of the present invention to enable easy production of a novel magnet having radial magnetic anisotropy and well suited for use in sound systems with freedom in choice of the material.

In accordance with the basic concept of the present invention, a thin strap is formed from a magnetic alloy which can be provided with magnetic anisotropy through spinodal decomposition etc, the thin strap is next subjected to age-hardening under magnetization in its thickness direction for provision of the magnetic anisotropy; and the strap after the age-hardening is taken up onto a tight roll of a prescribed shape.

DESCRIPTION OF THE PREFERRED EMBODIMENTS

In accordance with the present invention, a thin strap is first formed from a magnetic alloy which can be provided with magnetic anisotropy through spinodal decomposition etc. Fe—Cr—Co type magnetic alloys or Cu—Ni—Fe type magnetic alloys (cunife, etc.) are used as typical spinodal decomposition type magnetic alloys. The Fe—Cr—Co type magnetic alloy may contain 2 to 30% by weight of Cr, 5 to 37% by weight of Co, and Fe substantially the balance. Conditionally, 0.1 to 8% by weight in full of one or more of Ti, Zr, Ni, V and Si may be contained also. The Cu—Ni—Fe magnetic alloy may contain 10 to 30% by weight of Ni, 10 to 30% by weight of Fe, and Cu substantially the balance. More preferably, the alloy should contain 15 to 25% by weight of Ni, 15 to 25% by weight of Fe, and Cu the balance.

Formation of the thin strap can be carried out in various ways already well known to one skilled in the art. In one example of the process, an ingot of the above-described alloy composition is prepared by casting. The ingot so prepared is deformed into a thin strap of a prescribed thickness by sequential application of hot forgoing, hot rolling and cold rolling. The thin strap so obtained is further subjected to so-called solution treatment which includes, in sequence, cold rolling, annealing and abrupt cooling. In the case of a Fe—Cr—Co type magnetic alloy, for example, the strap is preferably annealed by heating at a temperature above 1050° C. for 5 to 8 minutes, and rapidly cooled thereafter.

Figure 1:
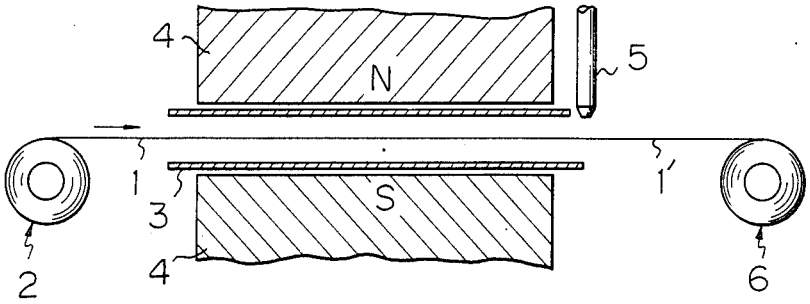
FIG. 1 is a simplified side view, partly in section, of one embodiment of the age-hardening process employed in production method of the present invention.

The thin strap so prepared is next subjected to age-hardening under magnetization in its thickness direction. One example of the process is shown in FIG. 1. An elongated, thin strap 1 of a magnetic alloy is delivered continuously from a supply roll 2 and advanced through a heater tube 3. Different poles 4 of a magnetizer are arranged on both radial sides of the heater tube 3 in order to magnetize the thin strap 1 in its thickness direction during its travel through the heater tube 3. A cooling nozzle 5 is arranged near the outlet of the heater tube 3 for ejection of air of room temperature. After delivery from the heater tube 3, a magnetized strap 1' is taken up tightly onto a take-up roll 6.

This age-hardening provides the thin strap with magnetic anisotropy in its thickness direction. That is, in the case of spinodal decomposition type magnetic alloys, highly magnetic phase fractions and nonmagnetic phase fractions are separated through spinodal decomposition caused by magnetization under heat application and the highly magnetic fractions phase are elongated in the thickness direction of the strap, thereby providing excellent magnetic anisotropy in the thickness direction.

The age-hardening under magnetization should be carried out at a heating condition conducive to spinodal decomposition of the magnetic alloys. More specifically, the initial heating is advantageously carried out at a temperature in a range from 670° to 720° C. for a period in a range from 10 to 60 minutes, and subsequent cooling down to 600° to 620° C. is carried out at a rate of 10° to 90° C./hr. After the subsequent cooling is complete, the magnetized strap is cooled rapidly.

The intensity of the magnetic field at the magnetization for age-hardening should preferably be in a range from 16,000 to 400,000 A/m, and more preferably in a range from 64,000 to 400,000 A/m.

When Fe—Cr—Co type magnetic alloys are used for formation of the thin strap, the above-described age-hardening under magnetization cannot produce sufficient difference in concentration between the highly magnetic and nonmagnetic phases. In order to cover this deficit in spinodal decomposition, secondary age-hardening is usually applied to the strap after taken up onto the tight roll. In connection with this, such secondary age-hardening should not precede taking-up onto the roll since the advanced application of the secondary age-hardening would impair good workability possessed by the strap just after the primary age-hardening and would seriously hinder smooth formation of the tight roll.

Figure 2:
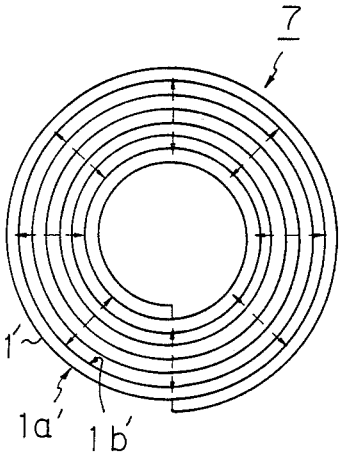
FIGS. 2 and 3 are plan views of the rolled strap obtained in the production method of the present invention.
Figure 3:
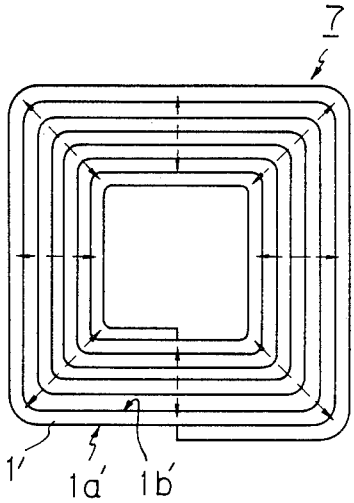

After the final age-hardening, the magnetized strap 1' is taken up tightly onto a roll which may be either round as shown in FIG. 2 or square as shown in FIG. 3 in cross sectional profile. In either case, a rolled strap 7 has a center space. In the structure of the rolled strap 7, one face 1*a'* of the strap 1' is located near the periphery of the rolled strap 7 and the other face 1*b'* of the strap 1' is located near the core of the rolled strap 7. As a consequence, the rolled strap 7 has radial magnetic anisotropy which is indicated with dot-line arrows in the illustration.

As remarked above, a secondary age-hardening is applied to such a rolled strap when the strap is made of Fe—Cr—Co type magnetic alloys. This secondary age-hardening is employed for the purpose of enlarging the difference in concentration between the highly magnetic and nonmagnetic phases, thereby making the magnetic anisotropy intenser. Preferably, the secondary age-hardening should be carried out in a temperature range from 620° to 500° C. with gradual lowering in temperature. Succh temperature lowering may be carried out either continuously or stepwise. Further, the secondary age-hardening may be carried out either with or without magnetization. When magnetization is adopted, the direction of magnetic flux in the field should meet the radial direction of the rolled strap. In addition to increase in intensity of magnetic anisotropy, application of the secondary age-hardening removes strain which was developed during formation of the tight, rolled strap.

Figure 4:
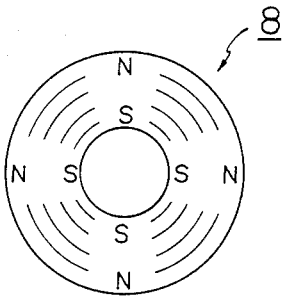
FIGS. 4 to 6 are plan views of several examples of the magnet produced by the method of the present invention.
Figure 5:
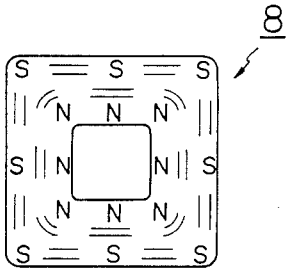
Figure 6:
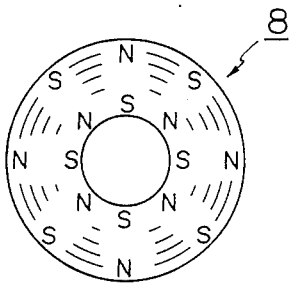

After the final age-hardening, the rolled strap is further magnetized so that different poles should be located on the different radial end sections of a permanent magnet 8 as shown in FIGS. 4 to 6. In the examples shown in FIGS. 4 and 5, same poles are located on a same radial end section of the permanent magnet 8. Whereas, in the example shown in FIG. 6, different poles are alternately located on a same radial end section of the permanent magnet 8. It is only required that, on a common radial line, different poles should be located on the different radial end sections of the permanent magnet 8.

As a result of the secondary age-hardening, there are produced lots of highly magnetic phase fractions in the magnetic alloy and they are highly elongated in the radial direction of the roller strap. By further magnetizing such a rolled strap having significant radial magnetic anisotropy, the resultant permanent magnet has excellent magnetic characteristics in its radial directions.

EXAMPLE

A Fe—Cr—Co type magnetic alloy was used for preparation of a thin, elongated strap having 0.2 mm. thickness and 100 mm. width. The alloy contained 24% by weight of Cr, 12% by weight of Co, and Fe substantially in balance. An ingot formed by vacuum casting was subjected to hot forgoing, hot rolling and cold working in order to be deformed into the strap. The strap was them passed, at a rate of 7 m/min, through a furnace of 5 m. length which had a uniform temperature section (1050° C.) of 1 m. length and was filled with hydrogen gas, for continuous annealing.

Primary age-hardening of the strap was carried out on an apparatus shown in FIG. 1. In heating of the strap, the strap was first heated at 700° C. for 30 minutes, the temperature was lowered down to 610° C. at a rate of 40° C./hr, and the temperature was further rapidly lowered down to the room temperature. The magnetic field was set to 150,000 A/m intensity.

Next, the strap was split to 2.0 mm. width and taken up onto a hollow roll of 8 mm. inner diameter, 25 mm. outer diameter and 2 mm. thickness.

The rolled strap was then subjected to secondary age-hardening in which the rolled strap was first heated at 650° C. for 60 minutes, and the temperature was next lowered down to 500° C. at a rate of 5° C./hr. After the age-hardening, the rolled strap was further magnetized in order to obtain a hollow, permanent magnet disc having different poles on different radial end sections.

Figure 7:
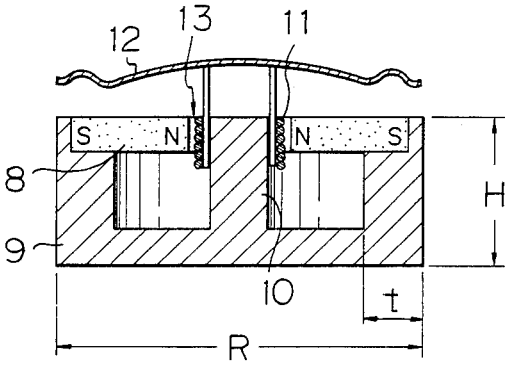
FIG. 7 is a simplified side sectional view of a loudspeaker magnetic circuit incorporating a magnet produced by the method of the present invention.

The magnet disc so produced was incorporated in a loudspeaker magnetic circuit as shown in FIG. 7. More specifically, the magnetic circuit included a yoke 9, a center pole 10 of the yoke 9, a voice coil 11 wound about the center pole 10 and a vibration plate 12 arranged over the yoke 9. The above-described permanent magnet disc 8 was arranged atop the yoke 9 surrounding the voice coil 11 on the center pole 10. The yoke 9 had an outer diameter (R) of 27 mm and a thickness (t) of 1.5 mm.

On such a magnetic circuit magnetic flux density Bg was measured at a circular gap 13 between the inner periphery of the permanent magnet disc 8 and the voice coil 11, and the measured value was equal to 1.0 T.

A like permanent magnet disc was prepared using same Fe—Cr—Co type alloy but without any application of age-hardening, and the permanent magnet disc 8 in FIG. 7 was replated by this sample for comparison. The magnetic flux density taken at the same place on the magnetic circuit amounted to 0.54 T.

From comparison of the data, it is quite evident that the radially anisotropic magnet produced in accordance with the present invention possesses excellent magnetic characteristics.

It is also clear from FIG. 7 that the height H of the magnetic circuit can be reduced by arrangement of the permanent magnet disc 8 atop the yoke 9. This assures very compact construction of the loudspeaker.

We claim:

1. A method for producing a magnet having radial magnetic anisotropy comprising the steps of forming a thin, elongated strap from a Cu—Ni—Fe spinodal decomposition type alloy which can be provided with magnetic anisotropy, subjecting said strap to age-hardening under concurrent magnetization in its thickness direction, and taking up said strap, after age-hardening, into a light, hollow roll of a prescribed shape.

2. A method for producing a magnet having radial magnetic anisotropy comprising the steps of forming a thin, elongated strap from a Fe—Cr—Co spinodal decomposition type alloy which can be provided with magnetic anisotropy, subjecting said strap to age-hardening under concurrent magnetization in its thickness direction, and taking up said strap, after age-hardening, into a tight, hollow roll of a prescribed shape, subjecting said roll of said strap to additional age-hardening.

3. A method as claimed in claim 1 further comprising the step of subjecting said roll of said strap to additional age-hardening.

4. A method as claimed in claim 2 in which
said Fe—Cr—Co type magnetic alloy contains 2 to 30% by weight of Cr, 5 to 37% by weight of Co, and Fe substantially the balance.

5. A method as claimed in claim 4 in which
said Fe—Cr—Co type magnetic alloy further contains 0.1 to 8% by weight in full of at least one of Ti, Zr, Ni, V and Si.

6. A method as claimed in either of claims 3 or 2 in which
said first-named age-hardening is carried out at a temperature conducive to spinodal decomposition of said magnetic alloy.

7. A method as claimed in claim 6 in which
said first-named age-hardening is carried out by heating said strap at a temperature in a range of 670° to 720° C. for a period of 10 to 60 minutes, lowering the temperature down to 600° to 620° C. at a rate of 10° to 90° C./hr, and quickly cooling the strap.

8. A method as claimed in either of claims 3 or 2 in which
intensity of the magnetic field at said first-named age-hardening is in a range from 16,000 to 400,000 A/m.

9. A method as claimed in either of claims 3 or 2 in which
said second-named age-hardening is carried out by gradually lowering the heating temperature of said roll of said strap from 620° to 500° C.

10. A method as claimed in either of claims 3 or 2 in which
said second-named age-hardening is performed with concurrent magnetization.

11. A method as claimed in either of claims 3 or 2 in which
said second-named age-hardening is performed without magnetization.

12. A method as claimed in claim 8 in which intensity of the magnetic field at said first-named age-hardening is in the range from 64,000 to 400,000 A/m.

13. A method as claimed in claim 7 in which
said second-named age-hardening is performed without magnetization.

14. A method for producing a magnet comprising the steps of
forming a thin, elongated strap from a Cu—Ni—Fe spinodal decomposition type magnetic alloy which can be provided with magnetic anisotropy, said alloy containing 10 to 30% by weight of Ni, 10 to 30% by weight of Fe and the balance being substantially Cu,
subjecting said strap to age-hardening under concurrent magnetization in its thickness direction, and
taking-up of said strap after said age-hardening onto a tight, hollow roll of a prescribed shape.

15. A method as claimed in claim 14 further comprising the step of subjecting said roll of said strap to additional age-hardening.

16. A method as claimed in claim 15 in which said alloy contains 15–25% by weight of Ni, 15–25% by weight of Fe and the balance being substantially Cu.

* * * * *